US010251465B2

(12) United States Patent
Alcantra et al.

(10) Patent No.: US 10,251,465 B2
(45) Date of Patent: Apr. 9, 2019

(54) ADJUSTABLE WAIST PAD FOR BELT

(71) Applicant: 5.11, Inc., Modesto, CA (US)

(72) Inventors: Cres Trilles Alcantra, Irvine, CA (US); Fernando Calderon Aguilar, Modesto, CA (US)

(73) Assignee: 5.11, INC., Modesto, CA (US)

( * ) Notice: Subject to any disclaimer, the term of this patent is extended or adjusted under 35 U.S.C. 154(b) by 217 days.

(21) Appl. No.: 15/201,051

(22) Filed: Jul. 1, 2016

(65) Prior Publication Data

US 2017/0000244 A1 Jan. 5, 2017

Related U.S. Application Data

(60) Provisional application No. 62/188,340, filed on Jul. 2, 2015.

(51) Int. Cl.
*A45F 3/04* (2006.01)

(52) U.S. Cl.
CPC ..... *A45F 3/04* (2013.01); *A45F 3/047* (2013.01); *A45F 2003/045* (2013.01)

(58) Field of Classification Search
CPC ..... A45F 3/047; A45F 3/06; A45F 2003/127; A45F 2003/144; A45F 2003/142; A45F 3/08; A45F 3/10
USPC ..... 224/153, 581, 631, 637, 650
See application file for complete search history.

(56) References Cited

U.S. PATENT DOCUMENTS

| | | | | |
|---|---|---|---|---|
| 4,318,502 | A * | 3/1982 | Lowe | A45F 3/04 224/153 |
| 5,114,059 | A | 5/1992 | Thatcher et al. | |
| 5,361,955 | A | 11/1994 | Gregory | |
| 5,564,612 | A | 10/1996 | Gregory | |
| 5,725,139 | A | 3/1998 | Smith et al. | |
| 5,762,243 | A | 6/1998 | McMaster et al. | |
| 5,860,769 | A * | 1/1999 | Seligman | A44B 11/263 224/264 |
| 5,954,253 | A * | 9/1999 | Swetish | A45F 3/08 224/628 |
| 6,626,342 | B1 | 9/2003 | Gleason et al. | |
| 6,886,727 | B2 | 5/2005 | Moore et al. | |
| 7,600,660 | B2 | 10/2009 | Kasper et al. | |
| 8,066,164 | B2 | 11/2011 | Gregory et al. | |
| 8,172,117 | B2 | 5/2012 | Maggi | |
| 8,360,289 | B2 | 1/2013 | Thibadeau, Jr. et al. | |
| 2003/0034372 | A1 | 2/2003 | Thompson et al. | |
| 2003/0121945 | A1* | 7/2003 | Lemanski, II | A45F 3/04 224/579 |
| 2005/0072825 | A1 | 4/2005 | Barr et al. | |
| 2005/0092802 | A1 | 5/2005 | Maley et al. | |
| 2005/0145663 | A1* | 7/2005 | Samuels | A01K 97/06 224/575 |
| 2006/0163305 | A1 | 7/2006 | Tong et al. | |

(Continued)

*Primary Examiner* — Derek J Battisti
(74) *Attorney, Agent, or Firm* — Kilpatrick Townsend & Stockton LLP

(57) ABSTRACT

A backpack is provided having a waist belt with removable and position-adjustable hip pads. Hardware on the hip pads allows the position of the hip pads to be readily adjusted along a wearer's waistline. The hardware also allows the hip pads to be separated from straps of the waist belt that connect to the backpack, for example, allowing the hip pads and a front clasping portion of the waist belt to be completely removed as a unit.

15 Claims, 5 Drawing Sheets

(56) References Cited

U.S. PATENT DOCUMENTS

| | | | | |
|---|---|---|---|---|
| 2009/0071990 | A1* | 3/2009 | Jardine | A45F 3/10 224/155 |
| 2010/0230458 | A1* | 9/2010 | Kramer | A45F 3/08 224/581 |
| 2012/0018479 | A1* | 1/2012 | Thibadeau, Jr. | A45F 3/047 224/637 |
| 2013/0240588 | A1* | 9/2013 | Milligan | A45F 3/047 224/580 |
| 2014/0252059 | A1* | 9/2014 | Paduano | A45F 3/047 224/637 |
| 2014/0361058 | A1* | 12/2014 | Gill | A45F 3/04 224/259 |

* cited by examiner

ADJUSTABLE WAIST PAD FOR BELT

CROSS-REFERENCES TO RELATED APPLICATIONS

The present application claims the benefit of U.S. Provisional Application No. 62/188,340 , filed on Jul. 2, 2015, the full disclosure of which is incorporated herein by reference.

BACKGROUND

Backpacks often include waist belts to help distribute some weight of a load away from shoulder straps and/or to secure a lower portion of the bag against a wearer's body to prevent the bag from bouncing or jostling excessively during use. Especially in larger packs with frames, pads are often provided in such waist belts to provide additional cushioning or anchor points for engaging the hips of a wearer to facilitate load transfer. However, the pads provided are often bulky, difficult to customize for a specific wearer, and not practical to remove in situations where a load is light enough that the pads are not needed. In smaller packs without frames, the load that can fit within the bag can typically be borne comfortably by the shoulders, so corresponding waist belts are usually used primarily for securing purposes instead of load-bearing. Hence, many waist belts on smaller packs are provided without pads and without any mechanism to add pads if desired. In some scenarios, this may provide a limitation on the ability of a wearer to effectively carry heavier objects like tools from the belt.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In light of certain aforementioned considerations, hip pads that are more readily removable, attachable, or otherwise more customizable by a specific user may be desirable.

In accordance with embodiments, a backpack is provided having a waist belt with removable and position-adjustable hip pads. Hardware on the hip pads allows the position of the hip pads to be readily adjusted along a wearer's waistline. The hardware also allows the hip pads to be separated from straps of the waist belt that connect to the backpack, for example, allowing the hip pads and a front clasping portion of the waist belt to be completely removed as a unit.

In one example embodiment, each side (e.g., a left side and a right side) of the belt has a rear strap, a hip pad, and a front strap. The rear strap extends from the backpack to the hip pad, and the front strap extends from the hip pad to a clasp. The clasps connect to one another for securing the sides of the belt together about the wearer's waist. The front strap and the rear strap are each length-adjustable relative to the hip pad, and the rear strap is releasably attached to the hip pad. In operation, the position of the hip pad can be moved forward along the wearer's waist by lengthening the rear strap. On the other hand, the position of the hip pad can be moved backward along the wearer's waist by shortening the rear strap. A corresponding change in length of the front strap can bring the total length of the side of the belt back to the length that the side of the belt had before the rear strap was adjusted. This may allow the clasp to be positioned in a desired location along the user's waistline, regardless of the position of the hip pad. In effect, once the hip pad has been positioned by adjusting the length of the rear strap, the placement of the clasp can be set by adjusting the length of the front strap. If the pads are not desired in particular circumstances, the pads can be removed by detaching the rear strap from each hip pad.

To facilitate such functions, the hip pad may include a single buckle with three attachment features: a first attachment feature to attach the rear strap to the buckle, a second attachment feature to attach the hip pad to the buckle, and a third attachment feature to attach the front strap to the buckle. The first attachment feature and the third attachment feature may respectively facilitate length adjustment of the rear strap and the front strap. The first attachment feature additionally may permit the rear strap to be selectively detachable from the hip pad. For example, the first attachment feature may be capable of receiving and releasing a complementary structure borne by the rear strap. The complementary structure may engage the first attachment feature in a manner that permits length-adjustment of the rear-strap relative to the complementary structure.

For a fuller understanding of the nature and advantages of the present invention, reference should be made to the ensuing detailed description and accompanying drawings.

BRIEF DESCRIPTION OF THE DRAWINGS

These and other features, embodiments, and advantages of the present disclosure are better understood when the following Detailed Description is read with reference to the accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Figure 1:
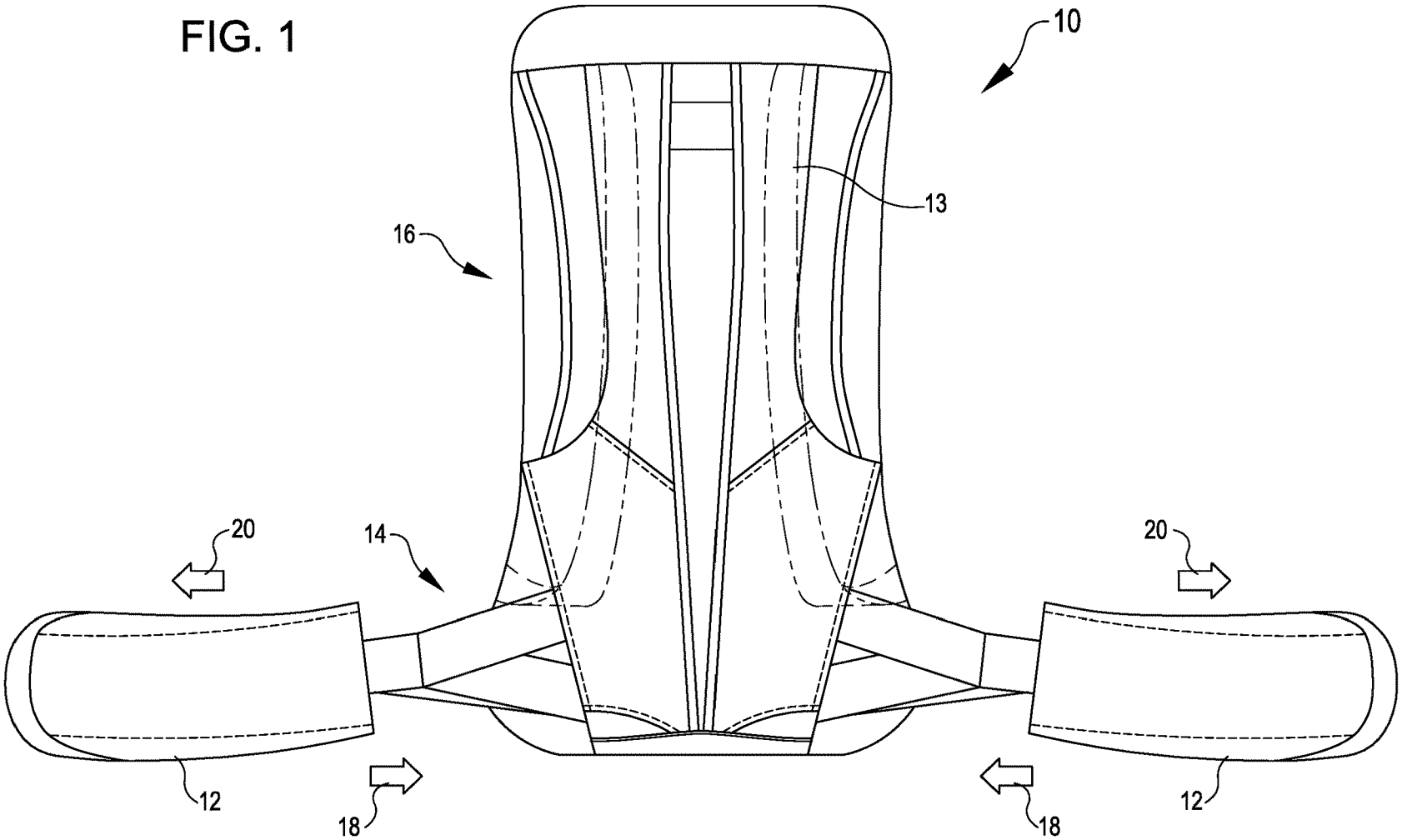
FIG. 1 shows a backpack with adjustable hip pads according to various embodiments.

Embodiments herein are directed to adjustable hip pads for backpacks. Referring now to the drawings, in which like reference numerals represent like parts throughout the several views, FIG. 1 shows a backpack 10 with adjustable hip pads 12 according to certain embodiments. The hip pads 12 form part of a waist belt 14 that extends from a bag portion 16. Shoulder straps 13 (shown in simplified form in phantom lines so as not to obscure other features from view) also extend from the bag portion 16 and in use typically transfer the bulk of the weight of the backpack 10 to a wearer's shoulders. The shoulder straps 13 may each extend from an upper part to a lower part of the bag portion 16. Although the shoulder straps 13 are shown attaching to the bag portion 16 at a location above where the waist belt 14 attaches, other attachment configurations may be used, including, but not limited to, arrangements in which the shoulder straps 13 attach above, below, between, and/or alongside anchor points of the waist belt 14. In use, the waist belt 14 can be worn around a waist of the wearer, such as to transfer load from the shoulder straps 13 and/or to hold the bag portion 16 more securely to the wearer's body than by the shoulder straps 13 alone.

The hip pads 12 are configured so that a position of the hip pads 12 along the waist belt 14 can be adjusted. For example, the hip pads can be moved along the waist belt 14 toward the bag portion 16 (e.g., shown by arrows 18) or away from the bag portion 16 (e.g., shown by arrows 20). Such movement allows a wearer of the backpack 10 to shift the hip pads 12 along the waist belt 14 so that the hip pads will be positioned at a desired position along the wearer's waistline when wearing the backpack.

The hip pads 12 are also configured so that the hip pads 12 can be readily removed from the waist belt 14 or re-installed on the waist belt 14. This gives a wearer the choice whether to wear the backpack with or without the hip pads 12.

The backpack 10 can include various features that can be assembled together to facilitate these functions. An assembly process for some embodiments will now be described beginning with FIG. 2; however, other features than those specifically shown or described beginning with FIG. 2 may additionally or alternatively be utilized. Additionally, although the assembly is described in a specific order, this order is utilized so that features are not obscured from view, and features may be assembled in a different order. Furthermore, although certain examples of materials may be described for particular features, any suitable material or combination of materials may be utilized, including, but not limited to, fabric (e.g., woven, non-woven, mesh, non-mesh, elastic/dimension-variable, dimension-stable, multi-layered), plastic, metal, composite, synthetic, and/or organic (e.g., wood or other plant fiber) material.

Figure 2:
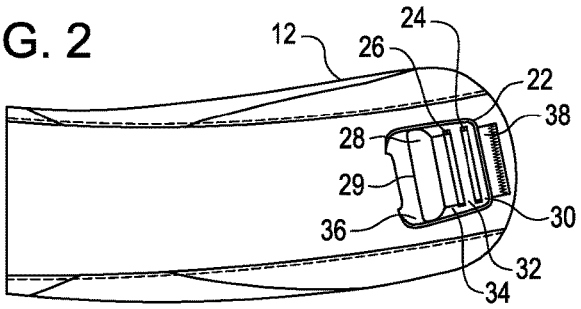
FIG. 2 shows an example of a hip pad that can be used for the backpack of FIG. 1 according to some embodiments.

FIG. 2 shows a hip pad 12 that can be used in the waist belt 14 of FIG. 1. The illustrated hip pad 12 is coupled with a buckle 22. The buckle 22 includes a first slot 24, a second slot 26, and an opening 28. A first bar 30 is defined between an exterior of the buckle 22 (e.g., a front edge shown on the right in FIG. 2) and the first slot 24, a second bar 32 is defined between the first slot 24 and the second slot 26, a third bar 34 is defined between the second slot 26 and the opening 28, and a fourth bar 36 is defined between the opening 28 and an exterior of the buckle 22 (e.g., a rear edge shown on the left in FIG. 2). A rim 29 around the opening 28 is defined at least in part by the third bar 34 and the fourth bar 36. Thus, proceeding from the rear toward the front of the buckle 22, features of the illustrated buckle 22 may be described in locational terms as a rear rim 29, a rear opening 28, a middle bar 34, a middle slot 26, a front bar 32, a front slot 24, and a leading bar 30. In some embodiments, the front bar 32 and the leading bar 30 may be and/or function as the same feature (e.g., if the front slot 24 is omitted or covered). Nevertheless, providing a front bar 32 and a leading bar 30 that are distinct from one another (e.g., as in the illustrated embodiment of FIG. 2) may provide improved friction characteristics for elements engaging the buckle 22 and/or other advantages.

The buckle 22 is shown attached to the hip pad 12 by a strap 38, such as a short length of webbing. The illustrated strap 38 is doubled over the third bar 34 of the buckle 22 and stitched to the hip pad 12 to secure the buckle 22 to the hip pad 12. Any other form of coupling the buckle 22 with the hip pad, however, may be used to supplement or substitute use of the strap 38.

Figure 3:
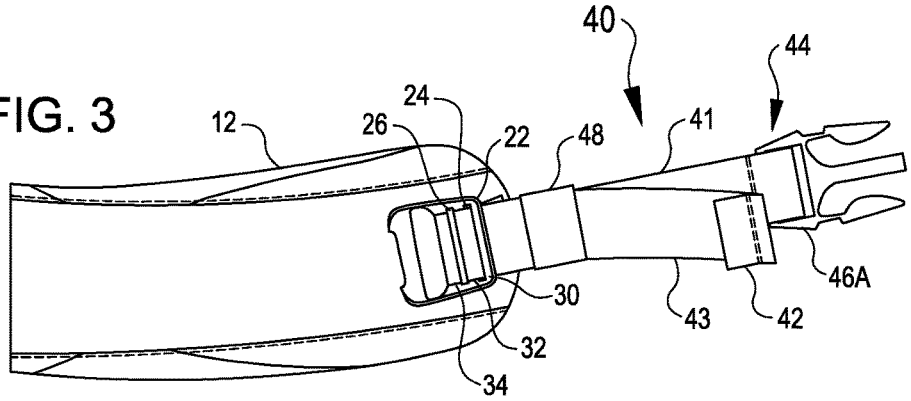
FIG. 3 shows a front strap to the hip pad of FIG. 2 according to some embodiments.

FIG. 3 shows attachment of a front strap 40 to the hip pad 12 via the buckle 22. The illustrated front strap 40 includes a free end 42 and a clasp end 44. The clasp end 44 is shown with a male portion 46A of a clasp, for example, for securing portions of the waist belt 14 together at a front of a wearer. The front strap 40 is routed through the second slot 26, over the second bar 32, through the first slot 24, and under the first bar 30. This results in the front strap 40 being doubled over the second bar 32 (e.g., forming an anchor segment 41 extending between the buckle 22 and the clasp end 44 and an adjustment segment 43 extending between the buckle 22 and the free end 42). This can also permit the front strap 40 to be length-adjustable relative to the hip pad 12. For example, pulling on the adjustment segment 43 of the front strap 40 causes the front strap 40 to slide over the second bar 32 and shortens a length of the anchor segment 41 extending between the buckle 22 and the clasp end 44, while increasing a length of the adjustment segment 43. To increase the length of the anchor segment 41 between the buckle 22 and the clasp end 44 (and produce a corresponding shortening of the adjustment segment 43), a user can pull on the anchor segment 41, for example, after lifting up on the first bar 30 to reduce an amount of friction that the first bar 30 might otherwise provide for securing the front strap 40 against inadvertent length adjustment. A guard 48 can also be provided about both the adjustment segment 43 and the anchor segment 41 of the doubled over front strap 40, such as to prevent the free end 42 from inadvertently passing back through the first slot 24 during adjustment and/or to keep the adjustment segment 43 organized and out of the way along the anchor segment 41. The guard 48 can be a tube, clip, or other suitable structure for accomplishing any combination of these functions. In certain embodiments, the guard 48 is formed of a fabric material, but it is contemplated that the guard 48 may be formed of plastic, metal, or any other suitable material or combination of materials.

Figure 4:
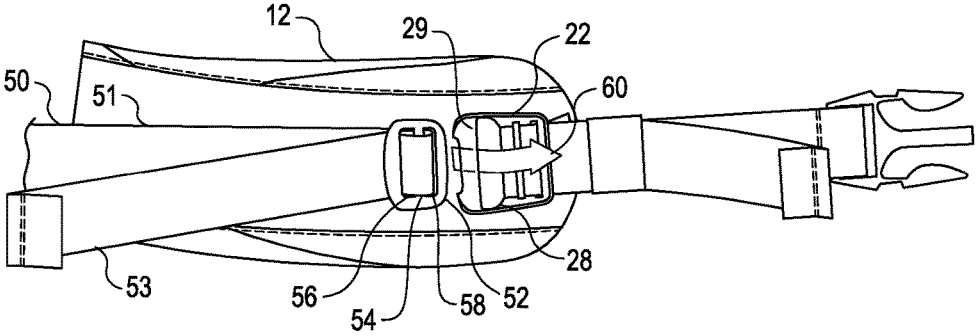
FIGS. 4-6 show a process of attaching a rear strap to the hip pad of FIGS. 1-2 according to some embodiments.
Figure 5:
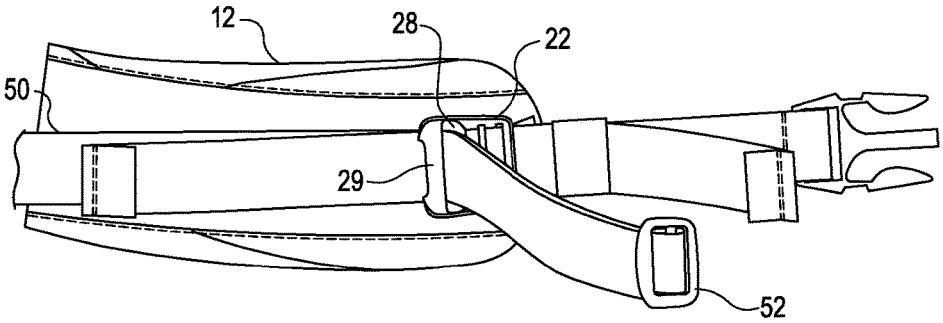
Figure 6:
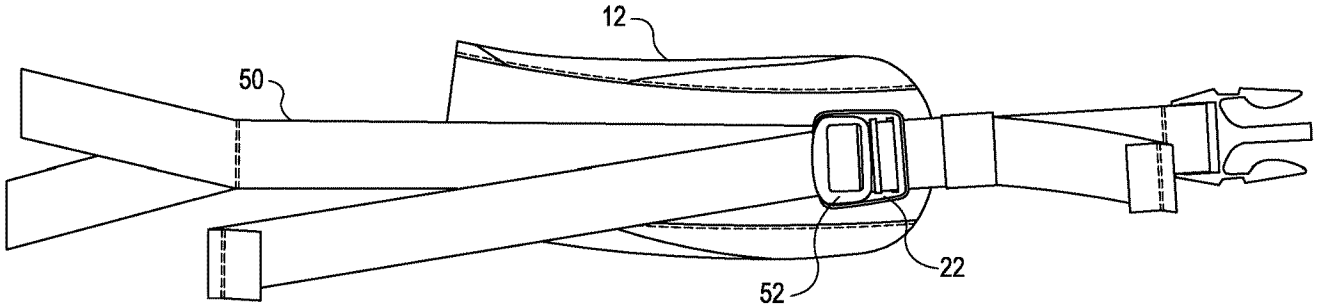

FIGS. 4-6 show attachment of a rear strap 50 to the hip pad 12 via the buckle 22. When attached, the rear strap 50 connects the hip pad 12 to the backpack 10, such as to a lateral side of a lower portion of the backpack 10 of FIG. 1. The illustrated rear strap 50 is coupled with a bracket 52. The bracket 52 includes a bar 54 e.g., defined, by a pair of slots 56 and 58. The rear strap 50 is doubled over the bar 54 (e.g., routed through the slots 56 and 58 to form an anchor segment 51 and an adjustment segment 53 similar to those of the front strap 40).

The opening 28 in the buckle 22 is sized to permit the bracket 52 to be moved through the opening 28. For example, as illustrated by arrow 60 in FIG. 4, the bracket 52 may be moved through the opening 28 from a position underneath the buckle 22 to a position above the buckle 22. This may correspond to a movement of the bracket 52 from one end of the buckle 22 to the other end (e.g., from left to right in FIG. 4). Once the bracket 52 has passed through the opening 28 of the buckle 22 (e.g., from the position shown in FIG. 4 to the position shown in FIG. 5), the bracket 52 can be positioned so as to be supported on top of the rim 29 around the opening 28 (e.g., moved to the position shown in FIG. 6). For example, to extend the bracket 52 through the opening 28, the plane of the bracket 52 is arranged transverse to the opening 28 so that the bracket 52 can extend through the opening 28. Then, the plane of the bracket 52 is changed to be parallel to the opening 28 so that the bracket 52 no longer fits through the opening 28. Such positioning may secure the bracket 52 against the buckle 22 while allowing the rear strap 50 to move over the bar 54. This allows the rear strap 50 to be length-adjustable relative to the hip pad 12 via the buckle in a similar manner to how the front strap 40 is length-adjustable via the buckle 22. The path of the bracket 52 can be reversed (e.g., moving from the position shown in FIG. 6, to the position shown in FIG. 5, and then to the position shown in FIG. 4) to detach the hip pad 12 from the rear strap 50.

Figure 7:
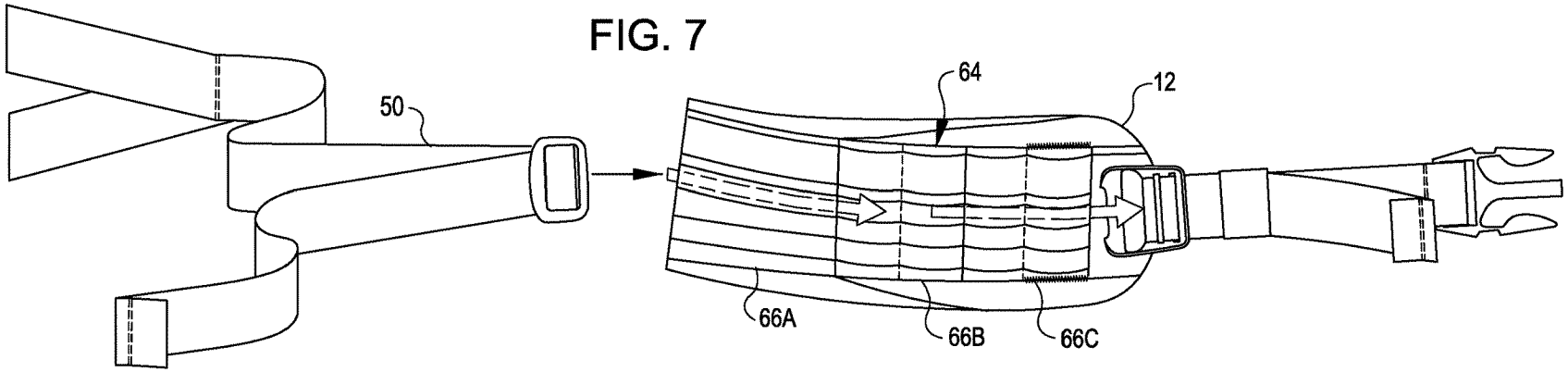
FIGS. 7-8 show an attachment base that can be used with the hip pad of FIGS. 1-6 according to some embodiments.
Figure 8:
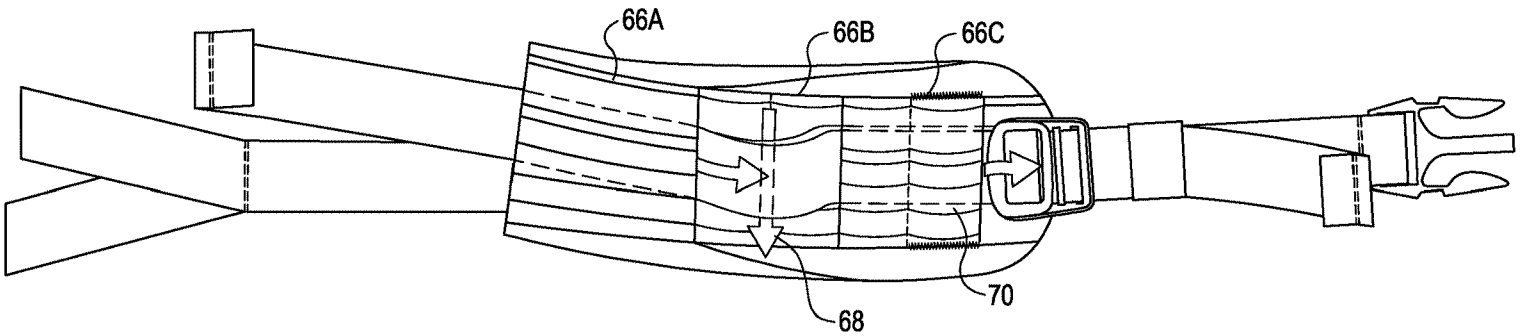
Figure 9:
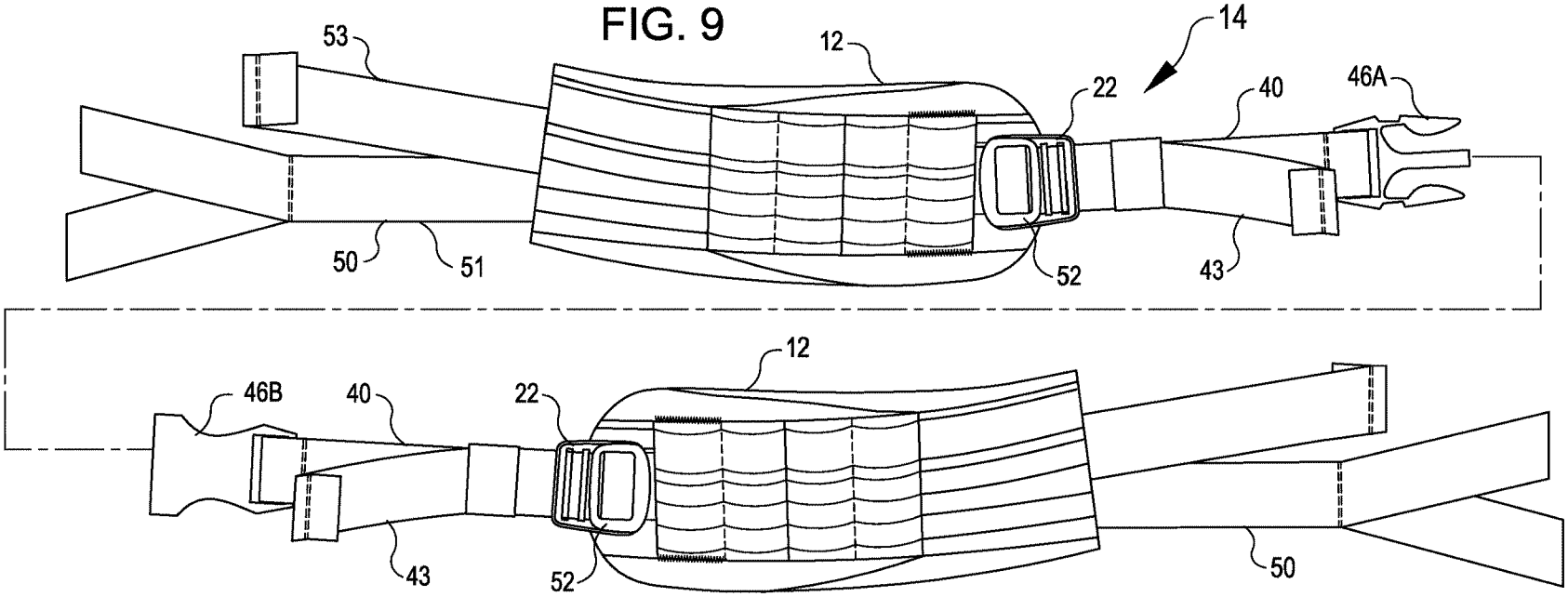
FIG. 9 illustrates a waist belt for a backpack formed from features shown in FIGS. 2-8 according to some embodiments.

FIGS. 7-8 illustrate an attachment base 64 that can also be provided on the hip pad 12. The attachment base 64 includes a series of panels 66 (e.g., individually denoted in FIG. 7 as 66A, 66B, and 66C). The panels 66 are attached to the hip pad 12 so as to form a tunnel through which the rear strap 50 can be routed. For example, the panels 66 in FIG. 7 are illustrated with the top and bottom edges stitched to the hip pad 12, while the ends of the panels 66 abutting adjacent panels (e.g., the left and right sides of each panel 66 shown in FIG. 7) are free rather than connected to one another or the hip pad 12. As may be seen in FIG. 8, the rear strap 50 can be woven outside of a panel 66B and through a loop, clip, or other attachment feature (represented by arrow 68) of a holster or other belt-supported object to secure the object to the hip pad 12. The panels 66 can also include attachment loops 70 (or other features) arranged in a pattern that facilitates attachment of objects through attachment systems such as MOLLE (Modular Lightweight Load-carrying Equipment). This may provide a wearer greater versatility in being able to carry gear or other objects on the waist belt 14 of the backpack, for example, allowing the wearer to choose between weaving the rear strap 50 through and/or around an object or using the attachment loops 70 (or other features) on the panels 66 to secure the object. For example, the wearer may choose between routing the rear strap 50 so as be woven outside of at least one of the panels 66 (e.g., as shown in FIG. 8, in which at least some of the attachment loops 70 on the middle panel 66B are blocked by the rear strap 50 while the attachment loops 70 on the forward panel 66C remain accessible), routing the rear strap 50 entirely behind all of the panels 66 (e.g., as shown in FIG. 9, in which none of the attachment loops 70 are blocked by the rear strap 50), or arranging the strap 50 completely outside of all the panels (not shown). In some embodiments, provision of an attachment base 64 may provide an interface for removably attaching the rear strap 50 to the hip pad 12. For example, the rear strap 50 may be removably attached to the hip pad 12 by routing the rear strap 50 through and/or behind at least some portion of the attachment base 64, such as in a scenario in which the strap 38 (FIG. 2) for securing the buckle 22 to the hip pad 12 is severed or omitted.

FIG. 9 illustrates a complete waist belt 14 assembled from features shown in FIGS. 2-8. The waist belt 14 is formed of two sides that each include a rear strap 50, a hip pad 12, and a front strap 40, for example, coupled together via a buckle 22. The sides are coupled together by mating portions of a clasp 46 (e.g., a male portion 46A with one or more prongs and a female portion 46B with notches or other structure for receiving and securing such prongs) on opposite sides of the belt. To adjust a position of a hip pad 12 along the waist belt 14 (e.g., so that the hip pad 12 will be positioned at a desired position along the wearer's waistline when the waist belt 14 is worn), a user can adjust a length of the front strap 40 and/or the length of the rear strap 50. For example, in the illustrated arrangement of FIG. 9, the user may move the right side hip pad 12 (shown in the top half of FIG. 9) backward (e.g., leftward in FIG. 9) by pulling the adjustment segment 53 of the rear strap 50 rearward (e.g., leftward in FIG. 9). For example, this backward movement of the hip pad 12 may correspond to movement toward the backpack 10 as illustrated by arrow 18 in FIG. 1. Alternatively, referring again to FIG. 9, the user may move the right side hip pad 12 in the opposite direction (e.g., rightward in FIG. 9) by pulling the buckle 22 forward (e.g., rightward in FIG. 9), for example, causing the rear strap 50 to slide within the bracket 52. This forward movement of the hip pad 12 may correspond to movement away from the backpack 10 as illustrated by arrow 20 in FIG. 1. Further, the user may shorten a length between the right side hip pad 12 and the clasp 46 by pulling the adjustment segment 43 of the front strap 40 forward (e.g., rightward in FIG. 9). On the other hand, the user can increase a length between the hip pad 12 and the clasp 46 by pulling the buckle 22 backward (e.g., leftward in FIG. 9), for example, causing the front strap 40 to slide within the buckle 22. To remove the hip pads 12 from the waist belt 14, the user can uncouple the brackets 52 from the buckles 22.

Figure 10:
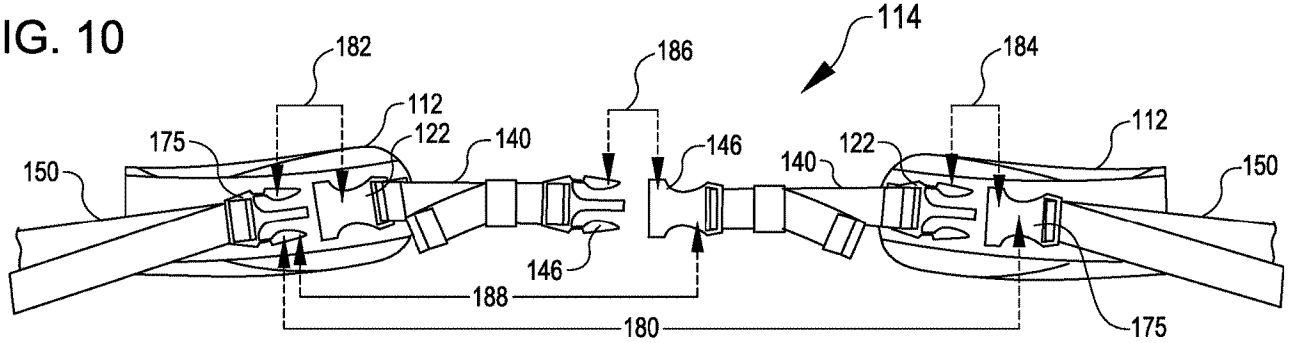
FIG. 10 illustrates another example of a waist belt with hip pads that can be used for the backpack of FIG. 1 according to some embodiments.

FIG. 10 illustrates another example of a complete waist belt 114 with a different type of hardware than is illustrated in FIG. 9. The arrangement in FIG. 10 can provide similar functionality to the arrangement in FIG. 9. For example, the waist belt 114 of FIG. 10 includes hip pads 112 having buckles 122 coupled with the hip pad 112, coupled with a front strap 140, and configured for releasable attachment with a rear strap 150. In FIG. 10, the buckles 122 are configured for releasable attachment with a rear strap 150 via mating structures 175 that are also compatible for attachment with one another. For example, in FIG. 10, the mating structures 175 on the rear straps 150 can be male and female components that can couple together (e.g., as illustrated by arrow 180), which may allow the rear straps 150 to be used as a securing belt in the absence of the removable hip pads 112. If the hip pads 112 are desired to be included, the mating structures 175 may instead be coupled with the buckles 122 (such as illustrated by arrows 182 and 184), e.g., so that the waist belt 114 with the hip pads 112 included can be secured using the front clasp (such as illustrated by arrow 186). Additionally, if the portions of the clasp 146 are also formed from hardware compatible with the mating structures 175, the waist belt 114 can also be configured so that just one of the hip pads 112 is included. For example, because the buckles 122, mating structures 175, and clasps 146 shown in FIG. 10 are formed from three sets of a standardized fastener having a female component and a male component, the male component corresponding to the mating structure 175 on the rear strap 150 on the left side of FIG. 10 can also alternatively couple (e.g., illustrated by arrow 188) with the clasp 146 on the front strap 140 on the right side of FIG. 10 (i.e., the opposite side of the waist belt 114) to form a waist belt 114 with one hip pad 112.

Figure 11:
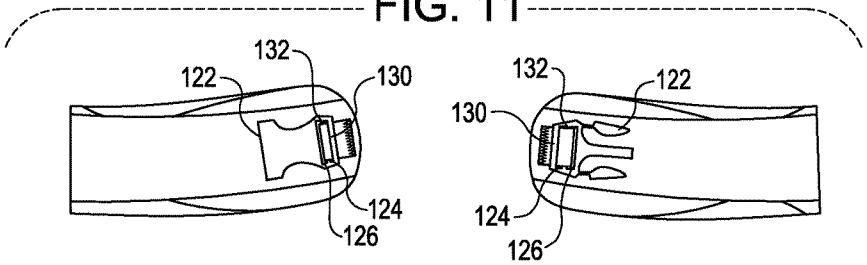
FIGS. 11 and 12 show attachment via buckles of the hip pads of FIG. 10 according to some embodiments.
Figure 12:
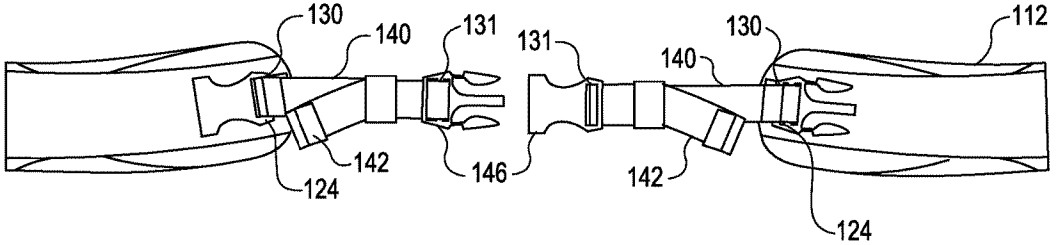

FIGS. 11 and 12 show attachment to the buckles 122 in greater detail. For example, as shown in FIG. 11, each buckle 122 includes a first slot 124 and a second slot 126. A first bar 130 is defined between an exterior of the buckle 122 and the first slot 124 and a second bar 132 is defined between the first slot 124 and the second slot 126. The buckle 122 is shown attached to the hip pad 112 by a strap 138 doubled over the second bar 132 of the buckle 22 and stitched to the hip pad 112 to secure the buckle 122 to the hip pad 112. As shown in FIG. 12, the front strap 140 is secured about the first bar 130. The front strap 140 is also routed through the clasp 146 (e.g., doubled over a bar 131 in the clasp 146) to cause the front strap 140 to be length-adjustable. Thus, in this illustrated embodiment of FIGS. 10-12, the front strap 140 may be shortened by pulling a free end 142 of the front strap 140 backwards, in contrast to the embodiment shown in FIG. 9, in which shortening is achieved by pulling a free end 42 forward to shorten a front strap 40. However, in some embodiments the front strap 140 of FIG. 10 may be reconfigured to shorten by pulling forward like the front strap 40 in FIG. 3 (or vice versa). Other features may also be interchanged from across various of the embodiments discussed herein, including, but not limited to the use of an attachment base 64 with the waist belt 114 of FIGS. 10-12.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of the invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein or in any contemporaneously filed Information Disclosure Statements are hereby incorporated by reference to the same extent as if each reference were individually and specifically indicated to be incorporated by reference and were set forth in its entirety herein.

What is claimed is:

1. A backpack comprising:

a bag;

a pair of shoulder straps, each extending from an upper part of the bag to a lower part of the bag; and a hip belt comprising:

a first rear strap extending from a first lateral side of the bag;

a first bracket comprising a first bar over which the first rear strap is doubled so as to allow the first rear strap to be length-adjusted by pulling the first rear strap over the first bar;

a first hip pad;

a first buckle comprising:

a first rear rim about a first opening of the first buckle, wherein the first opening is sized to permit the first bracket to be passed through the first opening from under the first opening and then positioned on top of the first rear rim about the first opening to releasably attach the first bracket to the first buckle in a manner that allows the first rear strap to be length-adjusted by pulling the first rear strap over the first bar;

a first middle bar coupled to the first hip pad by a piece of webbing, the piece of webbing being looped over the first middle bar and secured to the first hip pad; and a first front bar;

a first front strap doubled about the first front bar to facilitate length-adjusting of the first front strap by pulling the first front strap over the first front bar;

a first front clasp portion secured to the first front strap;

a second rear strap extending from a second lateral side of the bag;

a second bracket comprising a second bar over which the second rear strap is doubled so as to allow the second rear strap to be length-adjusted by pulling the second rear strap over the second bar;

a second hip pad;

a second buckle comprising:

a second rear rim about a second opening of the second buckle, wherein the second opening is sized to permit the second bracket to be passed through the second opening from under the second opening and then positioned on top of the second rear rim about the second opening to releasably attach the second bracket to the second buckle in a manner that allows the second rear strap to be length-adjusted by pulling the second rear strap over the second bar;

a second middle bar coupled to the second hip pad by a piece of webbing, the piece of webbing being looped over the second middle bar and secured to the second hip pad; and a second front bar;

a second front strap doubled about the second front bar to facilitate length-adjusting of the second front strap by pulling the second front strap over the second front bar; and a second front clasp portion secured to the second front strap, the second front clasp portion being releaseably engageable with the first front clasp portion to secure the hip belt about a waist of a wearer when the backpack is worn by the wearer.

2. The backpack of claim 1, wherein the first front clasp portion comprises a male part with prongs, and wherein the second front clasp portion a female part configured to receive said prongs.

3. The backpack of claim 1, further comprising a first attachment base including a first panel secured to the first hip pad so as to permit the first rear strap to be selectively routed between at least:

a configuration in which the first rear strap is positioned in a tunnel formed between the first panel and the first hip pad; and a configuration in which the first rear strap is positioned exterior to the tunnel.

4. The backpack of claim 3, wherein the first panel includes a plurality of attachment loops configured for securing gear through a MOLLE attachment system.

5. A backpack comprising:

a bag;

a pair of shoulder straps, each extending from an upper part of the bag to a lower part of the bag; and a hip belt comprising:

a first rear strap extending from a first lateral side of the bag;

a first hip pad, the first rear strap releasably attached to the first hip pad and length-adjustable relative to the first hip pad;

a first front strap that is length-adjustable relative to the first hip pad;

a first bracket borne by the first rear strap;

a first buckle attached to the first hip pad and configured to secure the first rear strap and the first front strap to the first buckle, the first buckle comprising a first rim around a first opening, the first opening sized to permit passage of the first bracket therethrough, the first rim sized for receiving the first bracket in engagement on a top of the first rim, the first buckle further comprising a bar configured to receive a piece of webbing that is looped over the bar and secured to the first hip pad, the first buckle further comprising a front bar over which the first front strap is doubled to facilitate length-adjusting of the first front strap by pulling the first front strap over the front bar;

a second rear strap extending from a second lateral side of the bag;

a second hip pad, the second rear strap releasably attached to the second hip pad and length-adjustable relative to the second hip pad;

a second front strap that is length-adjustable relative to the second hip pad; and a clasp for securing the hip belt about a waist of a wearer, the clasp comprising a first part coupled with the first front strap and a second part coupled with the second front strap.

6. The backpack of claim 5, wherein the first hip pad is position-adjustable along a wearer's waistline by length-adjusting the first rear strap relative to the first hip pad.

7. The backpack of claim 5, wherein the hip pads are separable from the rear straps so as to selectively remove the hip pads and the clasp of the hip belt as a unit.

8. The backpack of claim 5, further comprising a second buckle attached to the second hip pad and configured to secure the second rear strap and the second front strap to the second buckle.

9. A hip pad for a backpack, the hip pad comprising:

a pad configured for placement along a hip of a wearer;

a buckle comprising:

a first attachment feature configured to receive a complementary structure borne by a rear strap so as to releasably attach the rear strap to the buckle; the complementary structure configured for adjusting a length of the rear strap at least when the complementary structure is releasably attached to the first attachment feature, wherein the first attachment feature comprises a rim around an opening and the complementary structure comprises a bracket, the opening sized to permit passage of the bracket therethrough, the rim sized for receiving the bracket in engagement on a top of the rim;

a second attachment feature configured for attaching the hip pad to the buckle and comprising a bar configured to receive a piece of webbing that is looped over the bar and secured to the hip pad; and a third attachment feature configured to attach a front strap to the buckle and comprising a front bar over which a front strap is configured to be doubled to facilitate length-adjusting of the front strap by pulling the front strap over the front bar.

10. The hip pad of claim 9, wherein the bracket is configured to be passed through the opening from under the opening and then positioned on top of the rim about the opening to releasably attach the bracket to the buckle, wherein the rear strap is doubled over a first bar in the bracket so as to allow the rear strap to be length-adjusted by pulling the rear strap over the first bar.

11. The hip pad of claim 9, further comprising the backpack, wherein the hip pad comprises a first hip pad, wherein the rear strap comprises a first rear strap, wherein the front strap comprises a first front strap, and wherein the backpack comprises:

a bag;

a pair of shoulder straps, each extending from an upper part of the bag to a lower part of the bag; and a hip belt comprising:

the first rear strap, extending from a first lateral side of the bag;

the first hip pad, the first rear strap releasably attached to the first hip pad and length-adjustable relative to the first hip pad;

the first front strap that is length-adjustable relative to the first hip pad;

a second rear strap extending from a second lateral side of the bag;

a second hip pad, the second rear strap releasably attached to the second hip pad and length-adjustable relative to the second hip pad;

a second front strap that is length-adjustable relative to the second hip pad; and a clasp for securing the hip belt about a waist of the wearer, the clasp comprising a first part coupled with the first front strap and a second part coupled with the second front strap.

12. The hip pad of claim 11, wherein the first hip pad is position-adjustable along a wearer's waistline by length-adjusting the first rear strap relative to the first hip pad;

wherein the hip pads are separable from the rear straps so as to selectively remove the hip pads and the clasp of the hip belt as a unit; and wherein the first buckle is attached to the first hip pad and configured to secure the first rear strap and the first front strap to the buckle.

13. The hip pad of claim 9, further comprising the backpack, wherein the hip pad comprises a first hip pad, wherein the buckle comprises a first buckle, wherein the bracket comprises a first bracket, wherein the front bar comprises a first front bar, wherein the rear strap comprises a first rear strap, wherein the front strap comprises a first front strap, and wherein the backpack comprises:

a bag;

a pair of shoulder straps, each extending from an upper part of the bag to a lower part of the bag; and a hip belt comprising:

the first rear strap, extending from a first lateral side of the bag;

the first bracket, wherein the first bracket comprises a first bar over which the first rear strap is doubled so as to allow the first rear strap to be length-adjusted by pulling the first rear strap over the first bar;

the first hip pad;

the first buckle, wherein the rim of the first buckle comprises a first rim and the opening of the first buckle comprises a first opening, wherein the first opening is sized to permit the first bracket to be passed through the first opening from under the first opening and then positioned on top a first rear rim about the first opening to releasably attach the first bracket to the first buckle in a manner that allows the first rear strap to be length-adjusted by pulling the first rear strap over the first bar, the first front strap doubled about the first front bar to facilitate length-adjusting of the first front strap by pulling the front strap over the first front bar;

a first front clasp portion secured to the first front strap;

a second rear strap extending from a second lateral side of the bag;

a second bracket comprising a second bar over which the second rear strap is doubled so as to allow the second rear strap to be length-adjusted by pulling the second rear strap over the second bar;

a second hip pad;

a second buckle comprising:

a second rear rim about a second opening of the second buckle, wherein the second opening is sized to permit the second bracket to be passed through the second opening from under the second opening and then positioned on top of the second rear rim about the second opening to releasably attach the second bracket to the second buckle in a manner that allows the second rear strap to be length-adjusted by pulling the second rear strap over the second bar;

a second middle bar coupled to the second hip pad by a piece of webbing, the piece of webbing being looped over the second middle bar and secured to the second hip pad; and a second front bar;

a second front strap doubled about the second front bar to facilitate length-adjusting of the second front strap by pulling the front strap over the second front bar; and a second front clasp portion secured to the second front strap, the second front clasp portion being releasably engageable with the first front clasp portion to secure the hip belt about a waist of the wearer when the backpack is worn by the wearer.

14. The hip pad of claim 13, wherein the first front clasp portion comprises a male part with prongs, and wherein the second front clasp portion a female part configured to receive said prongs;

wherein the backpack further comprises a first attachment base including a first panel secured to the first hip pad so as to permit the first rear strap to be selectively routed between at least:

a configuration in which the first rear strap is positioned in a tunnel formed between the first panel and the first hip pad; and a configuration in which the first rear strap is positioned exterior to the tunnel; and wherein the first panel includes a plurality of attachment loops configured for securing gear through a MOLLE attachment system.

15. The backpack of claim 8, further comprising a second bracket borne by the second rear strap; and wherein the second buckle comprises a second rim around a second opening, the second opening sized to permit passage of the second bracket therethrough, the second rim sized for receiving the second bracket in engagement on a top of the second rim.

* * * * *